United States Patent [19]

Russell

[11] 4,046,172

[45] Sept. 6, 1977

[54] WEAVING DEVICE

[76] Inventor: Carolyn G. Russell, 6015 Summer Trace Apt. 105, Memphis, Tenn. 38128

[21] Appl. No.: 756,486

[22] Filed: Jan. 3, 1977

[51] Int. Cl.[2] ..... D03D 29/00

[52] U.S. Cl. ..... 139/33

[58] Field of Search ..... 139/29, 30, 31, 32, 139/33; 28/15

[56] References Cited

U.S. PATENT DOCUMENTS

| | | | |
|---|---|---|---|
| 278,982 | 6/1883 | Long | 139/33 |
| 829,474 | 8/1906 | Hooper | 139/33 |
| 1,160,132 | 11/1915 | Bliss | 139/33 |
| 2,139,879 | 12/1938 | Clark et al. | 139/33 |

FOREIGN PATENT DOCUMENTS

| | | | |
|---|---|---|---|
| 493,207 | 5/1950 | Belgium | 139/33 |

*Primary Examiner*—Henry S. Jaudon
*Attorney, Agent, or Firm*—John R. Walker, III

[57] ABSTRACT

A device for spreading lengths of warp thread mounted on a weaving frame to allow lengths of weft thread to be woven therethrough. The device includes an elongated bar member rotatably mounted to the weaving frame for passage underneath the lengths of warp thread. A plurality of transverse slots are provided through the bar member for selectively allowing certain ones of the lengths of warp thread to be received therein. Certain of the plurality of slots are substantially 180° opposed from other ones of the plurality of slots so that certain ones of the lengths of warp thread will be received in certain ones of the plurality of slots while other ones of the lengths of warp thread are held substantially on the outer circumference of the bar member to create a shed between certain ones of the lengths of warp thread to allow lengths of weft thread to be easily woven therethrough. When the bar member is rotated substantially 180° upon the frame, certain ones of the lengths of warp thread that were held substantially on the outer circumference of the bar member will be received in certain ones of the plurality of slots while certain ones of the lengths of warp thread that were received in certain ones of the plurality of slots will be held substantially on the outer circumference of the bar member to thereby aid in weaving lengths of weft thread through the lengths of warp thread.

8 Claims, 9 Drawing Figures

WEAVING DEVICE

BACKGROUND OF THE INVENTION

1. Field of the Invention

This invention relates generally to weaving frames of the type used to weave fabric from lengths of warp and weft thread.

2. Description of the Prior Art

In general, fabric is now woven on two types of devices: a floor loom and a weaving frame. A floor loom is a heavy, expensive structure which lacks certain versatility desired by a weaving artist or the like. For example, the fabric in a floor loom is woven in a horizontal position and is wound around a bar member as it is woven, thereby making it difficult or impossible for the weaving artist to view the entire woven web of fabric as it is woven. A weaving frame consists, in general, of an open-faced frame onto which a series of lengths of warp thread are mounted in substantially parallel alignment with one another. A series of lengths of weft thread are then woven transversely through the series of lengths of warp thread to thereby create a web of woven fabric. While such weaving frames can be used in a vertical position to allow the weaving artist to view the entire woven web of fabric as it is woven, such weaving frames have not heretofore been provided with efficient means for separating the lengths of warp thread to allow lengths of weft thread to be easily woven therethrough. A floor loom, on the other hand, is usually provided with means comprised of a series of parallel strips of wire (i.e., a reed) to separate the lengths of warp thread to allow the lengths of weft thread to be easily woven therethrough. However, such means are disadvantageous because, for example, the reed portion thereof requires time-consuming procedures in order to separate the lengths of warp thread. That is, the warp thread must first be threaded through the series of parallel strips of wires of the reed. Another disadvantage with such means is the complexity thereof, especially of the construction of the reed part thereof.

The inventor is aware of a toy-type device for use with a weaving frame which consists of an elongated bar member for passage underneath the lengths of warp thread mounted on the frame. This bar member includes three or four substantially transverse slots per inch for receiving the lengths of warp thread. Certain of these transverse slots are substantially 180° opposed from other ones of the slots so that certain of the lengths of warp thread will be separated from one another since certan ones of the lengths of warp thread will be held on the outer circumference of the bar member while other ones of the lengths of warp thread will be received in the slots.

SUMMARY OF THE INVENTION

The present invention is directed towards overcoming the problems and disadvantages of prior fabric weaving devices. The concept of the present invention is to provide a typical weaving frame with a simple, fast-acting means for spreading or separating the lengths of warp thread.

The spreader means of the present invention includes, in general, an elongated bar member for being rotatably mounted to a typical fabric weaving frame and for passage underneath the lengths of warp thread mounted to the frame. The bar member includes a plurality of substantially transverse slots for receiving the lengths of warp thread. Certain ones of the plurality of slots are substantially 180° opposed from other ones of the plurality of slots so that certain ones of the lengths of warp thread will be received in certain ones of the plurality of slots while other ones of the lengths of warp thread are held substantially on the outer circumference of the bar member to create a shed between certain ones of the lengths of warp thread and so that when the bar member is rotated substantially 180° upon the frame, certain ones of the lengths of warp thread that were held substantially on the outer circumference of the bar member will be received in certain ones of the plurality of slots while certain ones of the lengths of warp thread that were received in certain ones of the plurality of slots will be held substantially on the outer circumference of the bar member. The spreader means also includes a hollow sleeve member for being attached to the frame and for substantially enveloping the bar. The sleeve member includes a plurality of substantially transverse slots for selectively guiding the lengths of warp thread into the plurality of slots in the bar member. The sleeve member allows the user of the device to easily change the pattern of the fabric being woven by changing the type weave being woven. That is, the sleeve member allows the bar member to be easily removed and replaced with another bar member having a different spacing of the slots therein which will result in a different type weave as will be apparent to those skilled in the art.

DESCRIPTION OF THE PREFERRED EMBODIMENT

Figure 1:
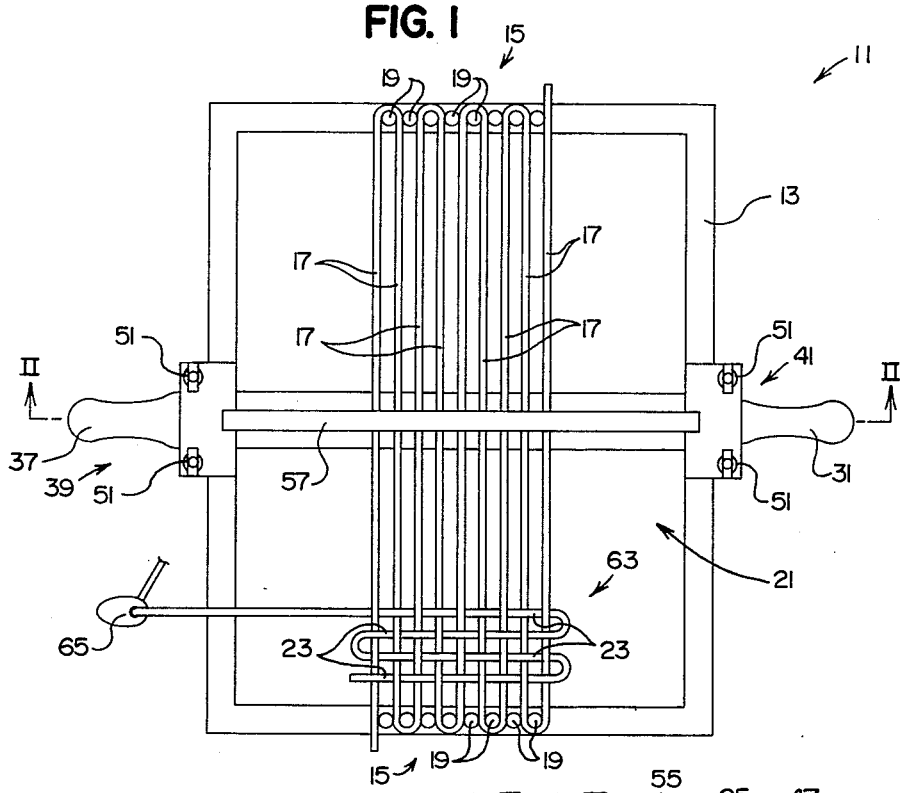
FIG. 1 is a top plan view of the weaving device of the present invention.
Figure 2:
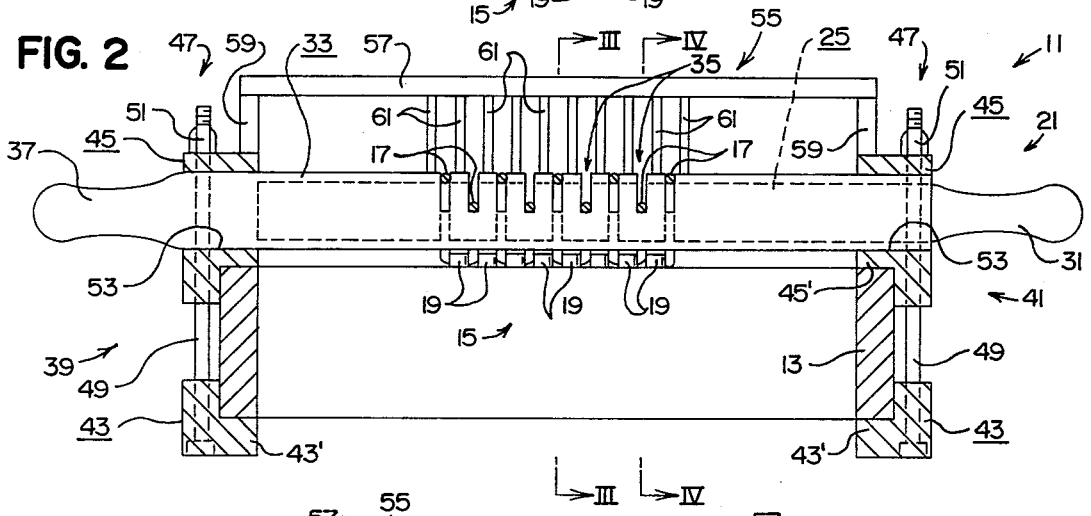
FIG. 2 is a sectional view of the weaving device as taken on line II—II of FIG. 1.

The weaving device 11 of the present invention is for use in weaving fabric from lengths of thread. The device 11 includes a substantially typical open-faced frame 13 which may be made in any size desired depending on the size of fabric to be woven, etc., and which may be made of wood or the like in any manner apparent to those skilled in the art. The device 11 also includes means 15 for allowing lengths of warp thread 17 to be mounted to the frame 13 (see, in general, FIG. 1). The means 15 may consist simply of a plurality of peg-like members 19 fixedly mounted to the frame 13 in positions so as to allow a series of lengths of warp thread 17 to be mounted to the frame 13 in a substantially parallel alignment with one another as shown in FIG. 1. It should be noted that the number of lengths of warp thread 17 and the spacing between adjacent ones of the lengths of warp thread 17 depends on the type fabric to be woven and the like as is apparent to those skilled in the art. Likewise, the number and spacing of the peg-like members 19 also depends on the type fabric to be woven and the like. Thus, the number and spacing of the lengths of warp thread 17 and the peg-like members 19 in FIGS. 1 and 2 is for purpose of example only. The peg-like members 19 may consist simply of a plurality of nails or the like hammered into the frame 13. The device 11 also includes a spreader means 21 attached to the frame 13 for selectively spreading the lengths of warp thread 17 apart to allow lengths of weft thread 23 to be easily woven through the lengths of warp thread 17. It should be noted that the lengths of warp thread 17 and weft thread 23 may each consist of a single, unitary length of thread in a manner well known to those skilled in the art and as shown in FIG. 1.

Figure 3:
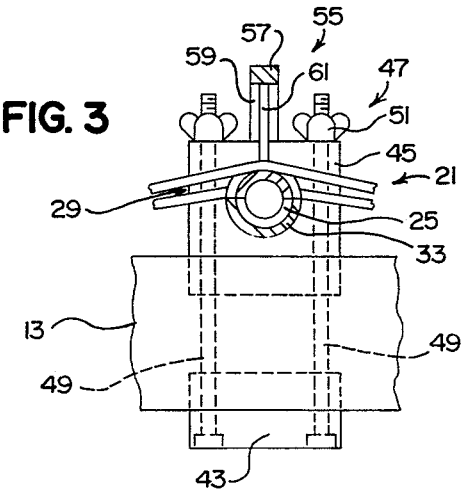
FIG. 3 is a sectional view of a portion of the weaving device as taken on line III—III of FIG. 2.
Figure 4:
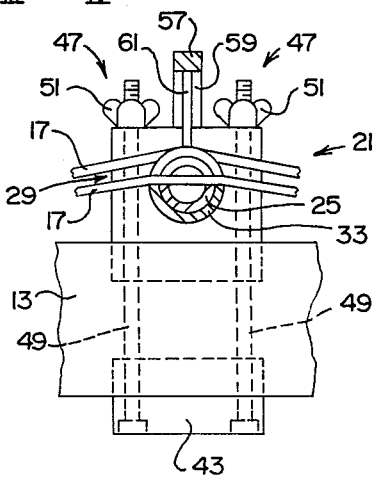
FIG. 4 is a sectional view of a portion of the weaving device as taken on line IV—IV of FIG. 2.
Figure 6:
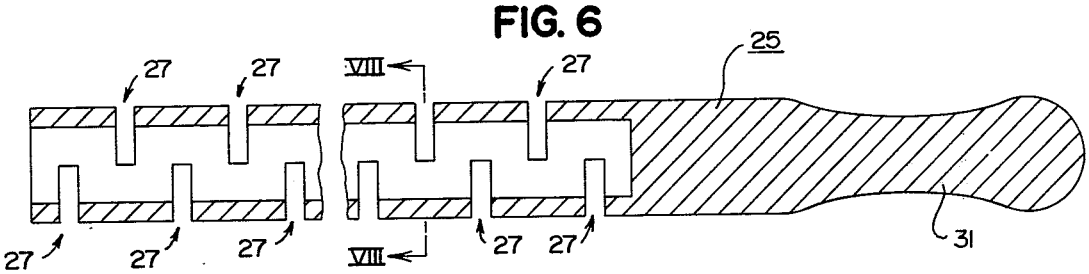
FIG. 6 is a sectional view of a bar member of the weaving device.
Figure 8:
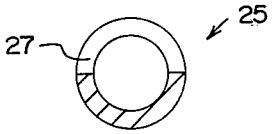
FIG. 8 is a sectional view of the bar member as taken on line VIII—VIII of FIG. 6.
Figure 9:
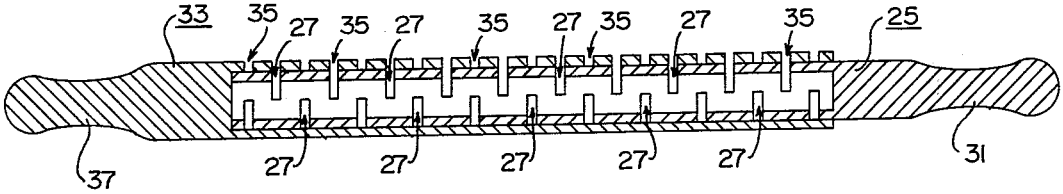
FIG. 9 is a sectional view of a sleeve member and a bar member of the weaving device similar to FIGS. 5 and 6 but showing the bar member received within the sleeve member.

The spreader means 21 includes an elongated bar member 25 for being rotatably attached to the frame 13 and for passage underneath the lengths of warp thread 17. The bar member 25 includes a plurality of substantially transverse slots 27 for receiving the lengths of warp thread 17 in a manner which will hereinafter become apparent. Each of the plurality of slots 27 are spaced apart from each adjacent one of the plurality of slots 27 a distance substantially equal to the distance between each adjacent ones of the lengths of warp thread 17 mounted on the frame 13. The number and spacing of slots 27 depend on the type fabric to be woven and the like. Thus, the number and spacing of the slots 27 shown in FIGS. 1, 2, 6 and 9 are for purpose of example only. Certain ones of the plurality of slots 27 are located on the bar member 25 substantially 180° opposed from other ones of the plurality of slots 27 (see FIG. 6) so that certain ones of the lengths of warp thread 17 will be received in certain ones of the plurality of slots 27 while other ones of the lengths of warp thread 17 are held substantially on the outer circumference of the bar member 25 to create a shed 29 between certain ones of the lengths of warp thread 17 as shown in FIGS. 3 and 4 and so that when the bar member 25 is rotated substantially 180° upon the frame 13, certain ones of the lengths of warp thread 17 that were held substantially on the outer circumference of the bar member 25 will be received in certain ones of the plurality of slots 27 while certain ones of the lengths of warp thread 17 that were received in certain ones of the plurality of slots 27 will be held substantially on the outer circumference of the bar member 25. The elongated bar member 25 is preferably a cylindrical member as shown in FIG. 8 and is preferably of a length to extend substantially completely across the frame 13 in a direction transverse to the lengths of warp thread 17 as shown in FIGS. 1 and 2. It should be noted that the bar member 25 is shown in FIGS. 1 and 2 as having slots 27 only in a portion of the length thereof. However, the bar member 25 would normally have slots 27 in substantially the entire length thereof as shown in FIG. 6. The actual number and spacing of the plurality of slots 27 depend on the type fabric to be woven as will be apparent to those skilled in the art. The bar member 25 may include a handle portion 31 for allowing the bar member 25 to be easily rotated by hand or the like. Additionally, the bar member 25 may be hollow to reduce the weight thereof and may be constructed of metal or the like.

Figure 5:
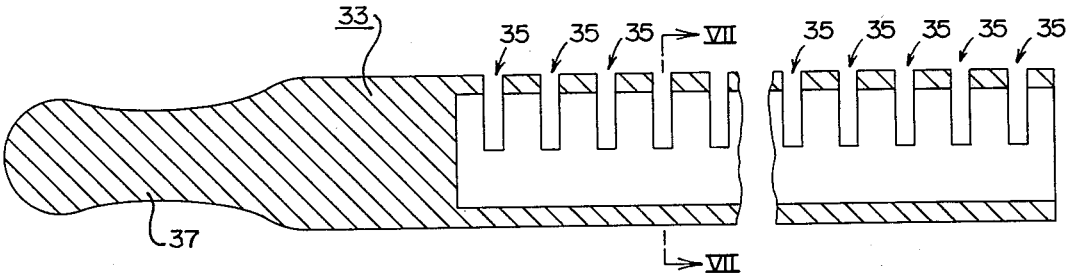
FIG. 5 is a sectional view of a bar member of the weaving device.
Figure 7:
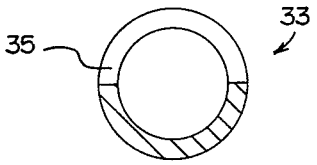
FIG. 7 is a sectional view of the sleeve member as taken on line VII—VII of FIG. 5.

The spreader means 21 also includes a hollow sleeve member 33 for being attached to the frame 13 and for substantially enveloping the bar member 25 as shown in FIGS. 1, 2, 3, 4 and 9. The sleeve member 33 includes a plurality of substantially transverse slots 35 (see FIG. 5). Each of the plurality of slots 35 are spaced apart from each adjacent one of the plurality of slots 35 a distance substantially equal to the distance between each adjacent ones of the lengths of warp thread 17 mounted on the frame 13. The number and spacing of slots 35 depend on the type fabric to be woven and the like. Thus, the number and spacing of the slots 35 shown in FIG. 1, 2, 5 and 9 are for purpose of example only. The plurality of slots 35 of the sleeve member 33 act to selectively guide each of the lengths of warp thread 17 into the plurality of slots 27 in the bar member 25 in a manner which will hereinafter become apparent. The sleeve member 33 is preferably an elongated, cylindrical member as shown in FIGS. 5 and 7 and is preferably of a length to extend substantially completely across the frame 13 in a direction transverse to the lengths of warp thread 17 as shown in FIGS. 1 and 2. It should be noted that the sleeve member 33 is shown in FIGS. 1 and 2 as having slots 35 only in a portion of the length thereof. However, the sleeve member 33 would normally have slos 35 in substantially the entire length thereof as shown in FIG. 5. The actual number and spacing of the plurality of slots 35 depend on the type fabric to be woven as will be apparent to those skilled in the art. The sleeve member 33 may include a handle portion 37 for allowing the sleeve member 33 to be easily rotated upon the frame 13 in a manner and for reasons which will hereinafter become apparent. The sleeve member 33 may be constructed of metal or the like.

Means may be provided for attaching the sleeve member 33 to the frame 13. More specifically, a pair of clamp-like members 39, 41 may be provided for being movably attached to the frame as shown in FIGS. 1 and 2. Each of the clamp-like members 39, 41 may include a lower portion 43 for engagement with the lower edge of the frame 13 and may include an upper portion 45 for engagement with the upper edge of the frame 13 as shown in FIG. 2. Each clamp-like member 39, 41 may include one or more fastening means 47 for fastening the lower and upper portions 43, 45 thereof to one another. Each of the fastening means 47 may include a bolt-like member 49 passing through apertures in each of the lower and upper portions 43, 45 and may include a wing nut member 51 or the like to secure the lower and upper portions 43, 45 to the bolt member 49 in a manner apparent to those skilled in the art. Each of the lower and upper portions 39, 41 preferably include an offset portion 43', 45', respectively, for engagement with the lower and upper edges of the frame 13 as clearly shown in FIG. 2. As should be apparent, when the offset portion 43', 45' are positioned on the lower and upper edges of the frame 13, the fastening means 47 will selectively cause the clamp-like member 39, 41 to be securely attached to the frame 13 in a manner similar to a well-known C-clamp. The upper portion 45 of each of the clamp-like members 39, 41 preferably includes an aperture 53 for allowing the sleeve member 33 to pass therethrough as clearly shown in FIG. 2. The apertures 53 are preferably of a size which allows the sleeve member 33 to be manually rotated therein for reasons which will hereinafter become apparent.

The spreader means 21 may include means 55 for confining each of the lengths of warp thread 17 to one of the plurality of slots 35 in the sleeve member 33. The confining means 55 may include an elongated member 57 for being fixedly mounted above, and being substantially coextensively with, the sleeve member 33 as clearly shown in FIGS. 1 and 2. A pair of leg-like members 59 are preferably provided to attach the elongated member 57 to the upper portion 45 of the clamp-like members 39, 41 as can be seen in FIGS. 2, 3, and 4. The confining means 55 also may include a plurality of downwardly directed members 61 fixedly attached to the elongated member 57 as shown in FIGS. 2, 3 and 4 for engaging the sleeve member 33 substantially intermediate each of the plurality of slots 35 in the sleeve member to confine each of the lengths of warp thread 17 substantially between adjacent ones of the plurality of slots 35 in the sleeve member 33 and between adjacent ones of the plurality of downwardly directed members 61 as shown in FIG. 2.

To use the weaving device 11 of the present invention, first, the lengths of warp thread 17 are mounted to the frame 13 in any manner known to those skilled in the art such as by winding a single length of thread around the peg-like members 19. The number and spacing of the lengths of warp thread 17 depend on the type fabric to be woven and the like as will be apparent to those skilled in the art. It should be noted that the lengths of warp thread 17 are passed between the plurality of downwardly directed members 61 of the confining means 55 and above the sleeve member 33 so as to engage the slots 35 of the sleeve member 33 as shown in FIG. 2. A length of weft thread 23 is then passed through the shed 29 substantially adjacent the sleeve member 33 thereby causing the length of weft thread 23 to be woven through the lengths of warp thread 17. Next, the bar member 25 is rotated causing certain of the lengths of warp thread 17 that were held substantially on the outer circumference of the bar member 37 to be received in certain ones of the plurality of slots 27 while certain lengths of warp thread 17 that were received in certain ones of he plurality of slots 27 will be held substantially on the outer circumference of the bar member 25. A length of weft thread 23 is then again passed through the shed 29 substantially adjacent the sleeve member 33 thereby causing a web 63 of woven fabric to be formed (see FIG. 1). The above steps are repeated until the desired size of fabric is woven. If a different type weave is desired to be woven, the sleeve member 33 is rotated substantially 180° so that all of the lengths of warp thread 17 will be held on substantially the outer circumference of the sleeve member 33 and above the slots 27 of the bar member 25. The bar member 25 is then pulled out of the sleeve member 33 and is replaced with another bar member 25 having a different spacing of the slots 27 (e.g., with one having every third slot 27 substantially 180° opposed from the adjacent slots 27 rather than having every other slot 27 so opposed). The above steps are then repeated thereby resulting in a different type weave as will be apparent to those skilled in the art. It should be noted that additional steps may be used as is well known to those skilled in the art. For example, a comb-like means (not shown) may be used to force the lengths of weft thread 23 tightly against the web 63 in a manner and for reasons well known to those skilled in the art. Additionally, a well-known needlelike member 65 may be used to aid in passing the lengths of weft thread 23 through the shed 29.

Although the invention has been described and illustrated with respect to a preferred embodiment thereof, it is not to be so limited since changes and modifications may be made therein which are within the full intended scope of the invention.

I claim:

1. Spreader means for use with a weaving device of the type including a frame and means for mounting lengths of warp thread to said frame to allow lengths of weft thread to be woven through the lengths of warp thread, said spreader means comprising: an elongated bar member for being rotatably attached to said frame and for passage underneath said lengths of warp thread, said bar member including a plurality of substantially transverse slots for receiving said lengths of warp thread, certain ones of said plurality of slots being substantially 180° opposed from other ones of said plurality of slots so that certain ones of said lengths of warp thread will be received in certain ones of said plurality of slots while other ones of said lengths of warp thread are held substantially on the outer circumference of said bar member to create a shed between certain ones of said lengths of warp thread and so that when said bar member is rotated substantially 180° upon said frame, certain ones of said lengths of warp thread that were held substantially on the outer circumference of said bar member will be received in certain ones of said plurality of slots while certain ones of said lengths of warp thread that were received in certain ones of said plurality of slots will be held substantially on the outer circumference of said bar member; and an elongated hollow sleeve member for being attached to said frame and for substantially enveloping said bar member, said sleeve member including a plurality of substantially transverse slots, each of said plurality of slots being spaced apart from each adjacent one of said plurality of slots a distance substantially equal to the distance between each adjacent ones of said lengths of warp thread for selectively guiding said lengths of warp thread into said plurality of slots in said bar member.

2. The spreader means of claim 1 in which is included means for confining each of said lengths of warp thread to one of said plurality of slots in said sleeve member.

3. The spreader means of claim 2 in which said confining means includes an elongated member for being fixedly mounted above and being substantially coextensively with said sleeve member and including a plurality of downwardly directed members for engaging said sleeve member substantially intermediate each of said plurality of slots in said sleeve member to confine each of said lengths of warp thread substantially between adjacent ones of said plurality of downwardly directed members.

4. The spreader means of claim 1 in which said bar member includes a handle portion for allowing said bar member to be easily rotated.

5. The combination with a weaving device of the type including a frame and means for mounting lengths of warp thread to said frame to allow lengths of weft thread to be woven through the lengths of warp thread, of a spreader means for selectively spreading said lengths of warp thread, said spreader means comprising:

a. a hollow, elongated sleeve member attached to said frame for passage underneath said lengths of warp thread, said sleeve member including a plurality of substantially transverse slots for selectively receiving said lengths of warp thread, each of said plurality of slots being spaced apart from each adjacent one of said plurality of slots a distance substantially equal to the distance between each adjacent ones of said lengths of warp thread;

b. means for confining each of said lengths of warp thread to one of said plurality of slots; and c. an elongated bar member rotatably positioned within said sleeve member, said bar member including a plurality of substantially transverse slots, each of said plurality of slots in said bar member being substantially aligned with one of said plurality of slots in said sleeve member for allowing said plurality of slots in said sleeve member to guide said lengths of warp thread into said plurality of slots in said bar member, each of said plurality of slots in said bar member being substantially 180° opposed from each adjacent one of said plurality of slots in said bar member so that each alternate one of said lengths of warp thread will be received in one of said plurality of slots in said bar member while each remaining ones of said lengths of warp thread will be held substantially on the outer circumference of said bar member to create a shed between each alternate ones of said lengths of warp thread and so that when said bar member is rotated substantially 180° within said sleeve member, said lengths of warp thread that were held substantially on the outer circumference of said bar member will be received in certain ones of said plurality of slots in said bar member while said lengths of warp thread that were received in certain ones of said plurality of slots in said bar member will be held substantially on the outer circumference of said bar member.

6. An improved weaving device of the type including a frame and means for mounting lengths of warp thread to said frame to allow lengths of weft thread to be woven through said lengths of warp thread, wherein said improvement comprises spreader means for selectively spreading said lengths of warp thread; said spreader means including an elongated bar member for being rotatably attached to said frame and for passage underneath said lengths of warp thread, said bar member including a plurality of substantially transverse slots for receiving said lengths of warp thread, certain ones of said plurality of slots being substantially 180° opposed from other ones of said plurality of slots so that certain ones of said lengths of warp thread will be received in certain ones of said plurality of slots while the other lengths of warp thread are held substantially on the outer circumference of said bar member to create a shed between certain ones of said lengths of warp thread and so that when said bar member is rotated substantially 180° upon said frame, certain of said lengths of warp thread that were held substantially on the outer circumference of said bar member will be received in certain ones of said plurality of slots while certain lengths of warp thread that were received in certain ones of said plurality of slots will be held substantially on the outer circumference of said bar member; said spreader means including an elongated hollow sleeve member for being attached to said frame and for substantially enveloping said bar member, said sleeve member including a plurality of substantially transverse slots, each of said plurality of slots being spaced apart from each adjacent one of said plurality of slots a distance substantially equal to the distance between each adjacent ones of said lengths of warp thread for selectively guiding said lengths of warp thread into said plurality of slots in said bar member.

7. A device for weaving fabric from lengths of warp and weft thread, said device comprising:

a. a frame;

b. means for mounting said lengths of warp thread to said frame;

c. spreader means for selectively separating said lengths of warp thread from one another to allow said lengths of weft thread to be woven therethrough, said spreader means including an elongated bar member rotatably mounted to said frame for passage beneath said lengths of warp thread, said bar member including a plurality of substantially transverse slots for selectively receiving said lengths of warp thread, each of said plurality of slots being spaced apart from one another a distance substantially equal to the distance between each adjacent ones of said lengths of warp thread, certain ones of said plurality of slots being substantially 180° opposed from other ones of said plurality of slots so that certain ones of said lengths of warp thread will be received in certain ones of said plurality of slots while the other lengths of warp thread are held substantially on the outer circumference of said bar member to create a shed between certain ones of said lengths of warp thread and so that when said bar member is rotated substantially 180° said lengths of warp thread that were held substantially on the outer circumference of said bar member will be received in certain ones of said plurality of slots while said lengths of warp thread that were received in certain ones of said plurality of slots will be held substantially on the outer circumference of said bar member; said spreader means including a hollow, elongated sleeve member for being attached to said frame and for substantially enveloping said bar member, said sleeve member including a plurality of substantially transverse slots, each of said plurality of slots being spaced apart from each adjacent one of said plurality of slots a distance substantially equal to the distance between each adjacent ones of said lengths of warp thread for selectively guiding said lengths of warp thread into said plurality of slots in said bar member.

8. The device of claim 7 in which said spreader includes means for confining each of said lengths of warp thread to one of said plurality of slots in said sleeve member.

* * * * *